US006755207B1

(12) United States Patent
Curtis et al.

(10) Patent No.: US 6,755,207 B1
(45) Date of Patent: Jun. 29, 2004

(54) VENTURI BASED LIQUID TRANSFER APPARATUS

(76) Inventors: Raymond Lee Curtis, 9820 Bradshaw Rd., Elk Grove, CA (US) 95624; Dale Eugene Bagley, P.O. Box 144, Pollock Pines, CA (US) 95726

( * ) Notice: Subject to any disclaimer, the term of this patent is extended or adjusted under 35 U.S.C. 154(b) by 63 days.

(21) Appl. No.: 10/103,257

(22) Filed: Mar. 19, 2002

Related U.S. Application Data

(60) Provisional application No. 60/279,979, filed on Mar. 29, 2001.

(51) Int. Cl.[7] ..... F04F 3/00
(52) U.S. Cl. ..... 137/205; 184/1.5
(58) Field of Search ..... 137/205; 184/1.5; 417/149, 148

(56) References Cited

U.S. PATENT DOCUMENTS 1,986,476 A * 1/1935 Ironside ..... 184/1.5
3,435,841 A * 4/1969 Williiams et al. ..... 137/205
4,285,360 A * 8/1981 Bauer ..... 137/205
4,378,026 A * 3/1983 Bauer ..... 137/205
5,425,333 A * 6/1995 Baylor et al. ..... 417/149
5,427,505 A * 6/1995 Payne ..... 137/205

* cited by examiner

*Primary Examiner*—Gerald A. Michalsky
(74) *Attorney, Agent, or Firm*—Theodore J. Bielen, Jr.

(57) ABSTRACT

A fluid transfer apparatus having a lid portion, and outer bucket and an insert container, forming a double wall container for the receipt of transferred fluid, the apparatus utilizes a compressed air to operate a venturi pump to remove fluids, such as oils and greases, from sources, such as engines and transmissions, for delivery to the double wall container. Activation of the venturi pump seals the lid to the inner and outer containers during liquid transfer operations. Safety checks are provided to ensure leak resistance should the unit inadvertently tip over.

18 Claims, 7 Drawing Sheets

48
86C
72D
72B
69
82
81
71
80
72A
79
72C
50
86A
72
76
75
77
62
89
95
93
91
68A
74
88
92
90
70
78
94
87
94D
97
68B
67
56
55
57
58V
58H
54
52
51
60
64
40
64U
14

VENTURI BASED LIQUID TRANSFER APPARATUS

CROSS-REFERENCES TO RELATED APPLICATIONS

The present invention is based on Provisional Application Serial No. 60/279,979, filed Mar. 29, 2001.

FIELD OF THE INVENTION

This invention pertains to an apparatus for the transfer of liquids such as oils, from a first location, such as an engine, to a second location, wherein the second location is a fluid receiver.

BACKGROUND OF THE INVENTION

Under governmental regulations the transfer or removal of oil and other hazardous liquids must be carried out in a controlled environment. Typically, such regulations apply to motor oil, transmission fluid, refrigeration oil, compressor oil, industrial hydraulic oil, electrical insulating liquids, and industrial process fluids, among many. Care must be taken to prevent hazardous fluids from contaminating water storage facilities through watershed runoff by percolating into soils. The same transferring precautions must also be followed with respect to other chemicals that are deemed to be hazardous to the environment.

The provision of a hazardous liquid transfer system would be a notable advance in the field of recycling of material from manufacturing and transportation endeavors.

SUMMARY OF THE INVENTION

The present invention pertains to a liquid transfer apparatus for removing liquid such as, but not limited to, oils and lubricants from engines and transmissions for recycling and disposal.

The apparatus includes as one of its elements a first outer bucket or container and a second inner liner or container. The second container nests within the first container. A lid portion sealingly engages the outer bucket and the inner container during fluid transfer operations. The lid portion includes at least one fluid inlet for the removal of fluid from a source to the inner container by the operation of an air-operated pump, disposed in the lid portion of the apparatus. The air activated pump operates on a venturi principle to evacuate air from the inner liner, thus creating a pressure differential for the inward flow of fluid from an external source into an inner container inlet. In other words, as air is evacuated from the containers, waste fluid simultaneously flows into the inner container. A float check valve in the air evacuation tube attached to the motor prevents overfill.

Sealing means is also provided between the lid and the outer and inner containers. Sealing may take the form of an "o" ring placed in a groove. Such sealing means is initiated by operation of the air ejection pump. Handles attached to the outer and inner containers permit easy handling of the same without interference with the sealing means. The handle of the outer container is conveniently held to the lid adjacent the air ejection pump. The handle to the inner container folds to the inner wall of the same above the maximum level of waste fluid therewithin.

The seals between the lid inner container and outer containers, as well as check valves the liquid inlet and air outlet to the system maintain a vacuum when the venturi pump is deactivated. The system may be moved without separation at this time.

It may be apparent that a novel and useful liquid transfer system has been described.

It is an object therefore of the present invention to provide a liquid transfer apparatus that avoids liquid spillage.

It is another object of the present invention is to provide a liquid transfer system that delivers liquid into a closed environment.

It is yet another object of the present invention is to provide a liquid transfer apparatus, which is lightweight and easy to carry.

It is a further object of the present invention is to provide a liquid transfer apparatus that automatically prevents overflow of the liquid receiver.

It is a still further object of the present invention is to provide a liquid transfer apparatus that utilizes compressed air rather than electrical power to achieve liquid transfer, thus, increasing safety in operation.

It is a still further object of the present invention to provide a liquid transfer system that utilizes various multi-gallon containers that are common to the work place, and achieves double wall containment.

It is another further object of the present invention to provide a self-sealing lid, inner container and outer bucket assembly that operates with an air powered motor which accomplishes safe liquid transfer.

It is yet a further object of the present invention to provide a liquid transfer apparatus that resists leakage if tipped over.

It is still another object of the present invention to provide a system for liquid transfer that protects the outer of two containers from damage.

It is yet another object of the present invention to provide means to collect heavy viscous materials such as grease, for disposal, directly from an electric motor bearing housing without disassembling the motor.

Another object of the present invention is to provide a double container system that only seals when both containers are nested, thus, protecting the outer container against damage by the application of a vacuum.

A further object of the present invention is to provide a liquid transfer system that utilizes double wall containment found in a pair of nested vessels, each of which is capable of containing a body of liquid.

Another object of the present invention is to provide a liquid transfer system which operates under a vacuum generated by an ejector pump and maintains such vacuum when the pump ceases to operate, such vacuum serving to hold assembled units together.

The invention possesses other objects and advantages especially as concerns particular characteristics and features thereof which will become apparent as the specification continues.

For a better understanding of the invention reference is made to the following detailed description of the preferred embodiments thereof which should be referenced to the above-described drawings.

DETAILED DESCRIPTION OF THE PREFERRED EMBODIMENTS

Various aspects of the present invention will evolve from the following detailed description of the preferred embodiments which should be taken together with the hereinbefore delineated drawings.

Figure 1:
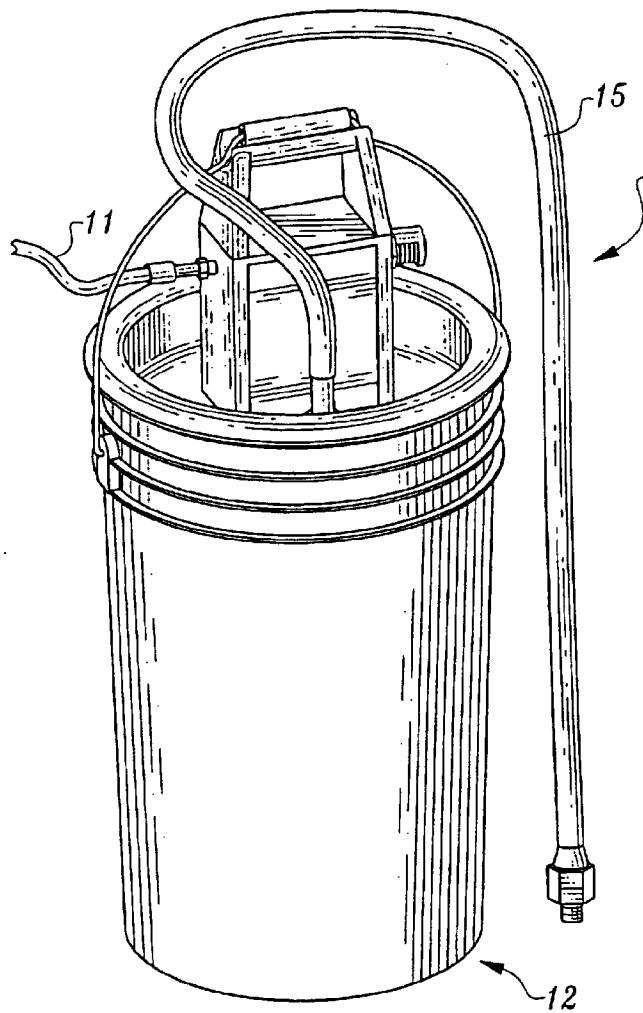
FIG. 1 is a perspective view of the apparatus of this invention, in an assembled state.

FIG. 1 shows the preferred embodiment of the assembled fluid transfer apparatus or unit of this invention, which is designated by reference character 10. As may be seen in FIG. 3, the apparatus has three main components, namely a first outer container or bucket 12, a second inner liner, insert, or container 13, and a lid portion 14, which supports pump 69 therein. A fourth portion comprises waste fluid hose 15, discussed in FIGS. 9 and 16. Air supply hose 11 not considered to be a part of the invention 10, although it is required in the working of unit 10. In certain cases, lid portion 14 may be employed with a single thick container, in substitution for containers 12 and 13.

Figure 2:
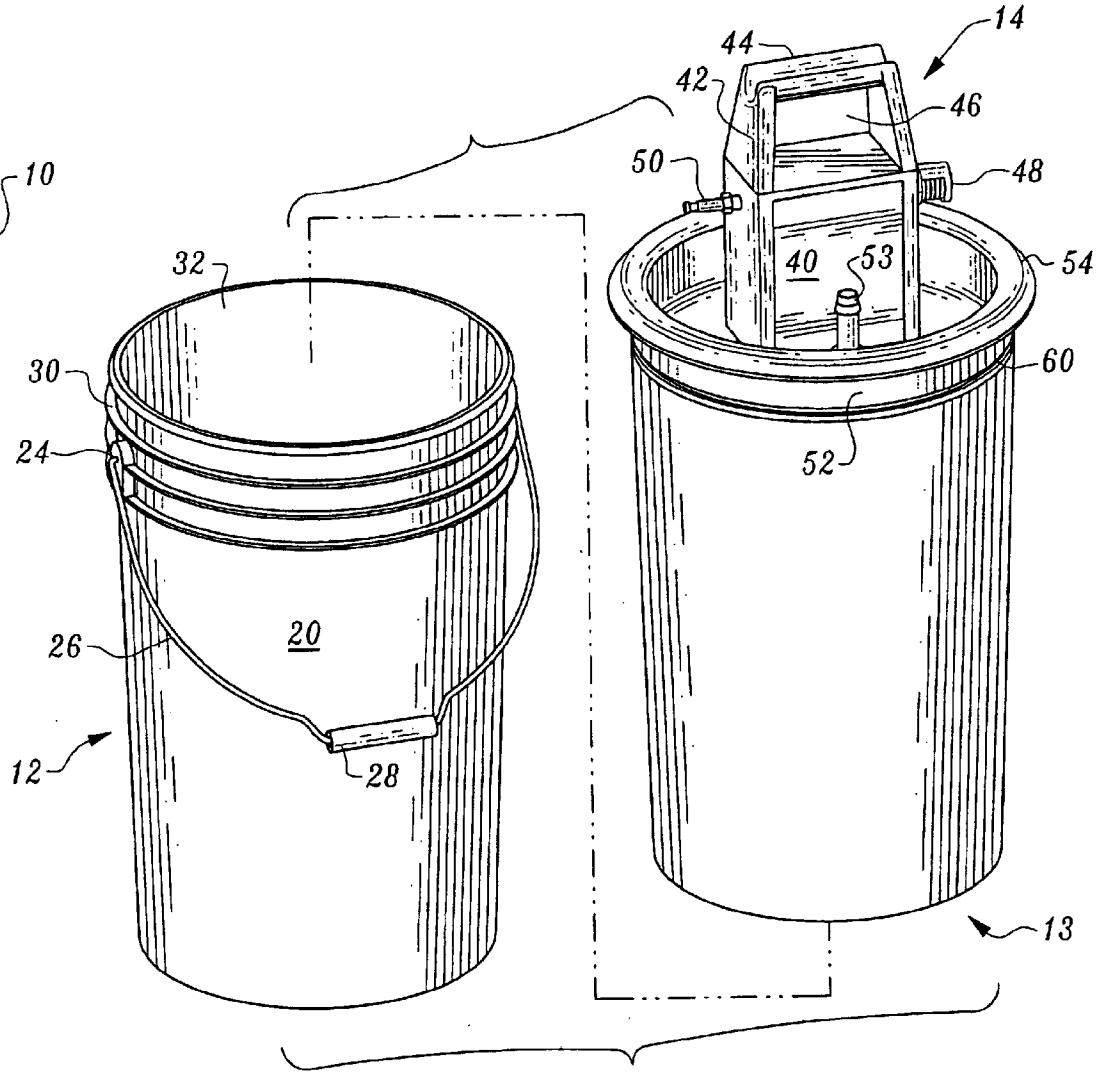
FIG. 2 is a front perspective view of the invention, partially disassembled in two parts.
Figure 8:
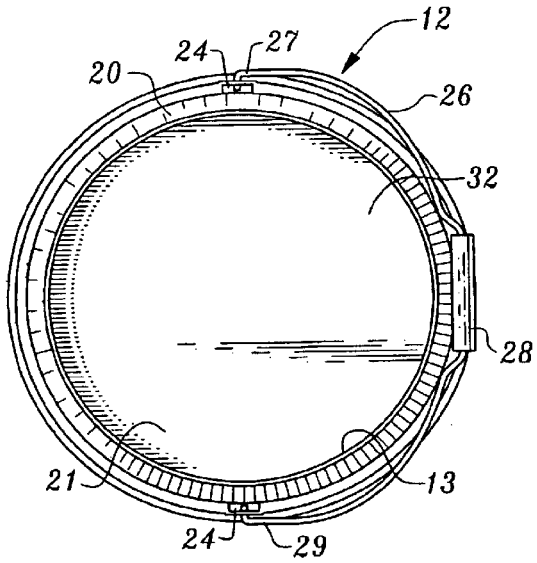
FIG. 8 is a top plan view of the outer container.

FIGS. 2 and 8, depict an outer bucket 12 having outer sidewall 20, with spaced reinforcing ridges 30 thereon, which extends outwardly from sidewall 20. Bucket 12 also includes bottom wall 21. Two handle mounts 24 are disposed 180 ndegrees apart and are connected or molded into sidewall 20. Ends 27 and 29 of handle 26 can be inserted in handle mounts 24. Outer bucket 12 is open at the top and possesses interior chamber 32, FIG. 7. Shown disposed on handle 26 is tubular handle grabber 28 which, optionally, can be permitted to rotate on handle 26.

FIG. 2 also shows inner liner, container or insert 13, which itself is also a bucket and upon which is disposed lid portion 14. Lid portion 14 supports pump housing 40, a generally rectangular enclosed box. Overlying the pump housing 40 is an inverted U-shaped handle 42, having a concave recess 44 to serve as a retainer for handle grabber 28 of outer container 12. When handle grabber 28 is located in recess 44, outer container 12 becomes affixed to lid portion 14 and apparatus 10 can be carried from one location to another by simply grasping handle 42.

On one sidewall of pump housing 40 is located compressed air quick connector plug 50 for attachment of air hose 11, seen on FIG. 1. On the sidewall of housing 40 opposite air quick disconnect plug 50, is located muffler 48 which dissipates the rushing air of pneumatic venturi pump 68, FIGS. 1 and 3. Venturi pump 69 will be detailed as the specification continues. Beneath recess or trough 44 of handle section 42 lies void 46 through which the user puts his hand when carrying lid portion 14, outer bucket 12 and inner liner 13, if so joined.

Figure 3:
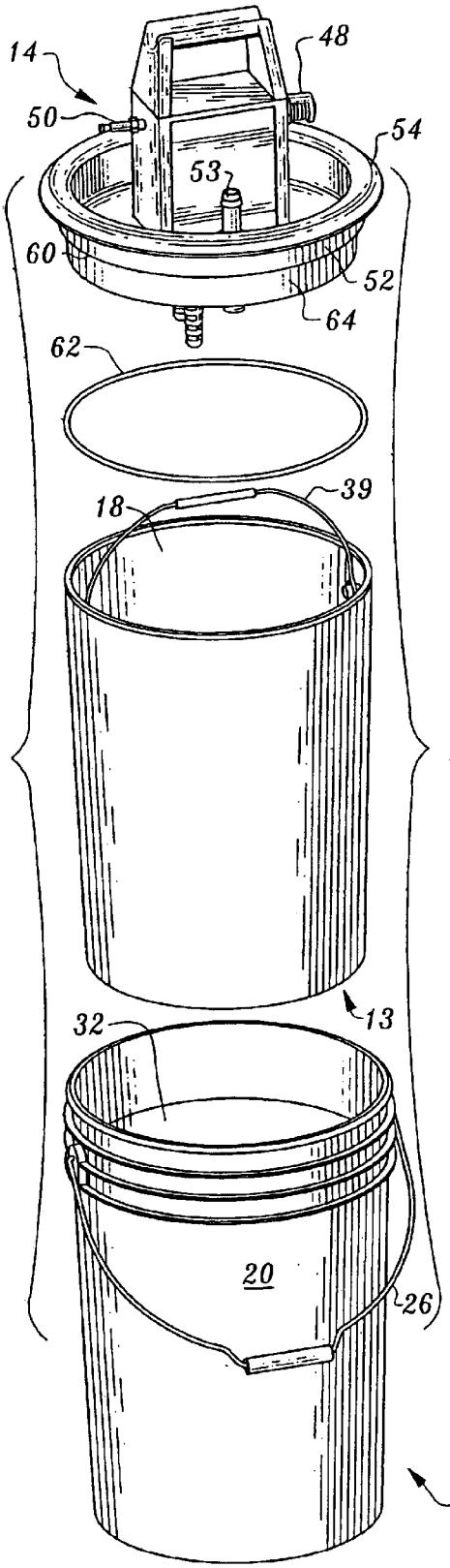
FIG. 3 is a front perspective view of the invention disassembled into four parts.
Figure 5:
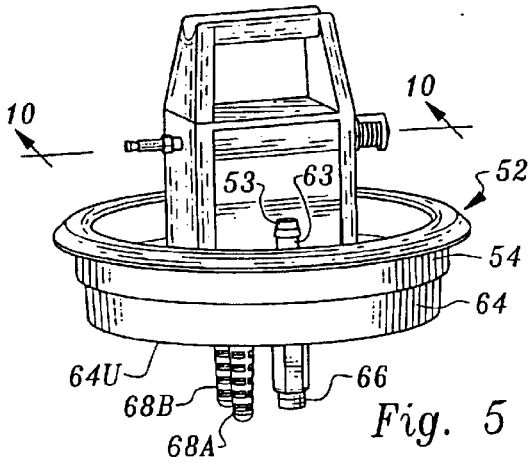
FIG. 5 is front perspective view of the lid portion of the present invention.

Recessed wall section 64 of lid 14, seen in FIGS. 3 and 5, is vertically disposed relative to outer bucket 12 when nested within liner insert 13. That is to say, rim 54 and surface 52 of lid 14 extend outside of chamber 32 of bucket 12 and liner insert 13. Integrated sealing ring groove slot 60, FIG. 3, retains sealing ring 62, such that sealing ring 62 creates a seal between bucket 12 liner insert 13, and lid 14 at its sidewall 52 and recessed wall section 64. Sealing ring 62 may take the form of an "o" ring as shown, or be formed into an oval ring, square ring, or the like.

FIG. 3, illustrates unit 10 in a full elevational exploded view. Thus, the area below recessed wall section 64 of lid 14 is partially visible. "O" ring slot 60, accommodating "o" ring 62, FIG. 10, lies between sidewall 52 and recessed wall section 64. Recessed section 64 is of a smaller cross-sectional span than the liner insert 13; span arrows 33 of FIG. 4.

Figure 4:
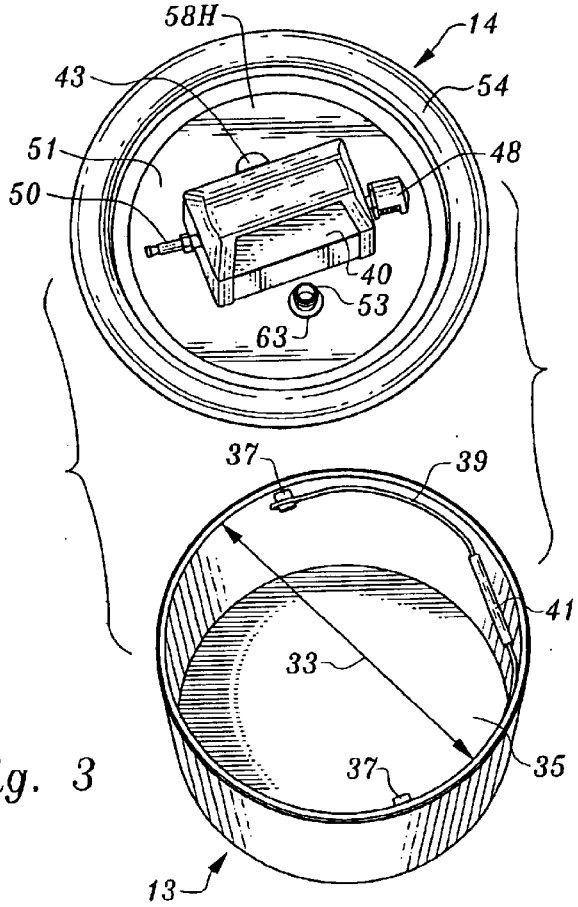
FIG. 4 is a top perspective view of the lid and separated inner liner container.

FIG. 4, indicates the liner insert 13 as having an interior mounted handle 39, fixed thereto via rivets 37. Handle 39 also has a tubular hand grabber 41 thereon. Optionally grabber 41 may rotate or be fixedly secured to handle 39. Also seen in FIG. 4 is the interior bottom wall 35 of liner insert 13.

Figure 6:
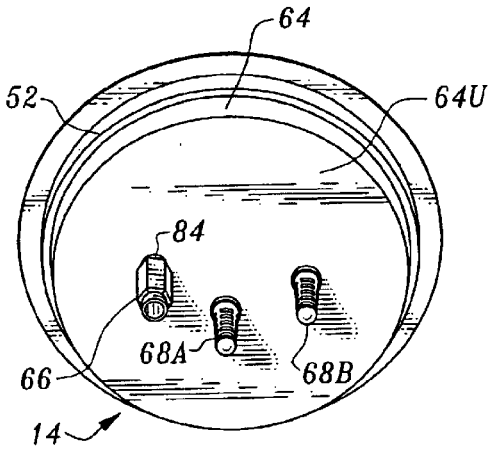
FIG. 6 is a bottom perspective view of the lid portion shown in FIG. 5.

FIGS. 4–6 and 16, depict lid 14 and shows recessed side wall section 64 terminating in a circular, flat disk bottom wall 64U, further apparent in FIG. 6. The cross-sectional span of bottom wall 64U is less than the diameter of the liner insert container 13, dimension arrow 33, seen in FIG. 4. Vacuum hose quick disconnect connector 53 threads into threaded nipple 63 of mold-in coupling 65 on lid 14, FIG. 16. Quick disconnect connector 53 provides a suction when unit 10 operates. Threaded cover or cap 43 threadedly engages nipple 55 of mold-in coupling 56 which serves as an alternate port. Nipple 55 can be used for negative pressure monitoring, and/or as an alternate liquid inlet with a vacuum hose, used for special liquid handling processes. Most importantly nipple 55 may be employed to release or break the vacuum generated in system 10 after venturi pump 69 is deactivated, hereinafter discussed. Removal of cap 43 will permit access to nipple 55.

Figure 16:
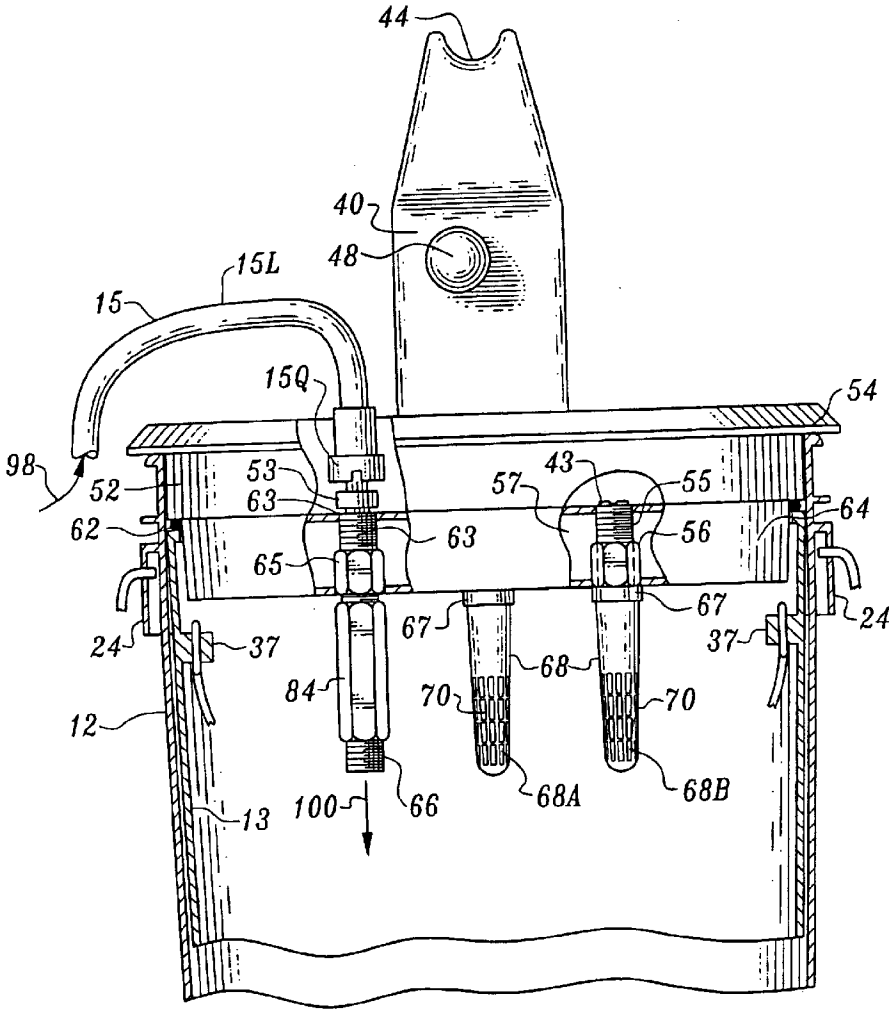
FIG. 16 is a cutaway, partial sectional, view showing nesting and sealing of the components of the present invention.

Disposed downwardly from the underside 64U of recessed section 64 are nipple 66, communicating with waste fluid nipple 63, and strainers 68A and 68B, FIG. 6. Nipple 66 and strainers 68A and 68B are connected into the base 64U of recessed section 64. The combination of nipple 66 and strainers 68A and 68B serves as a three-legged balancing member, In other words, suction strainers 68A and 68B, taken together with nipple 66, all are of approximately the same length, as seen in FIG. 16, and are disposed in a triangular pattern. Any oil atop lid 14 would remain there when lid 14 rests on a ground surface balanced on nipple 66 and strainers 68A and 68B, since lid surface 58 remains horizontal.

Figure 7:
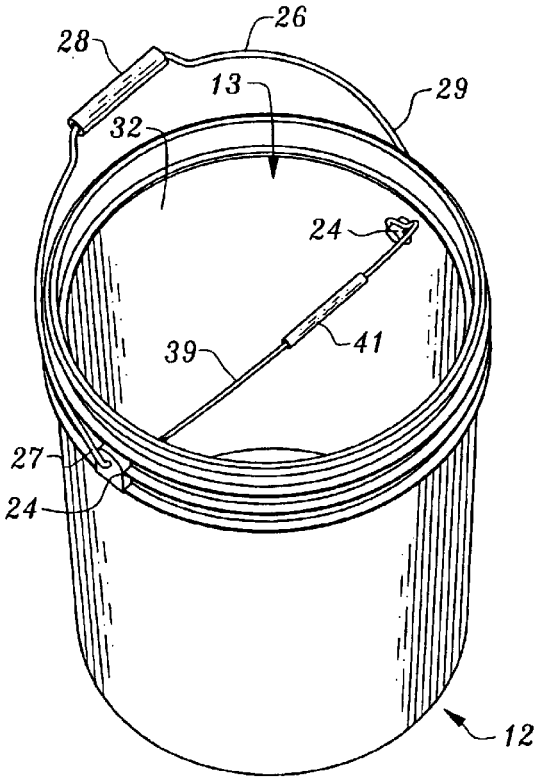
FIG. 7 is a top perspective view of the outer container and nested insert container.

FIG. 7 illustrates, in perspective, the nesting capability of liner insert container 13 into outer bucket 12. The main purpose for the double wall containment is to minimize leakage. Consequently, the walls of both liner insert container 13, and the outer bucket 12 must be penetrated for a containment failure to occur. Also, when a vacuum is pulled on unit 10, greater structural rigidity is obtained due to the close proximity of liner insert container 13 within outer bucket 12. Another purpose for using one container within another is to provide extra strength, obviating buckling or collapse during fluid transfer to liner insert container 13. In certain cases, containers 12 and 13 may be formed into a single thickened container to achieve such strength. Both containers 12 and 13 are sealed off when a vacuum is applied to unit 10 by the meeting of the lid portion 14 to liner insert container 13 and outer bucket 12, which will be detailed hereinafter.

Figure 9:
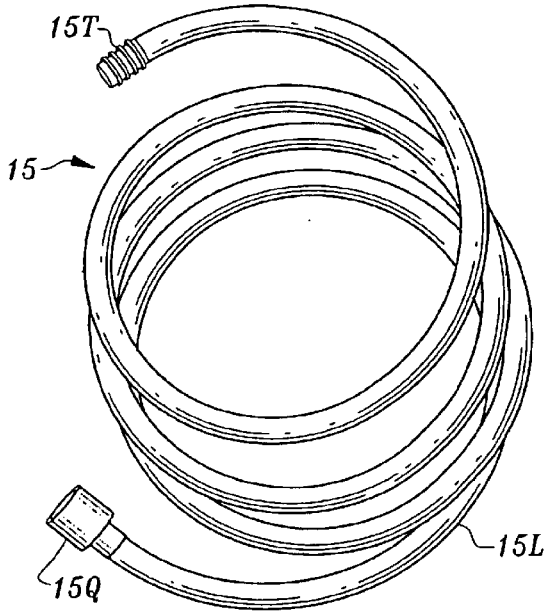
FIG. 9 is a perspective view of the hose element of the present invention.

FIG. 9 illustrates exemplary waste liquid hose 15 having a length of tubing with a female quick connector 15Q on one end for attachment to male quick connector, 53 of lid portion 14, FIGS. 4 and 16. The opposite end of hose 15 includes a threaded connector 15T thereon for passing waste liquid to a storage (not shown) via a conventional female pipe thread, or universal adapter. It should be noted that the quick connector 53 could be replaced with barbed universal tubing connectors if desired, commensurate with the vacuum pressure rating, achieved by venturi ejector pump 69, described hereinafter, as well as industrial hydrocarbon compatibility standards.

Figures 10, 12, 13:
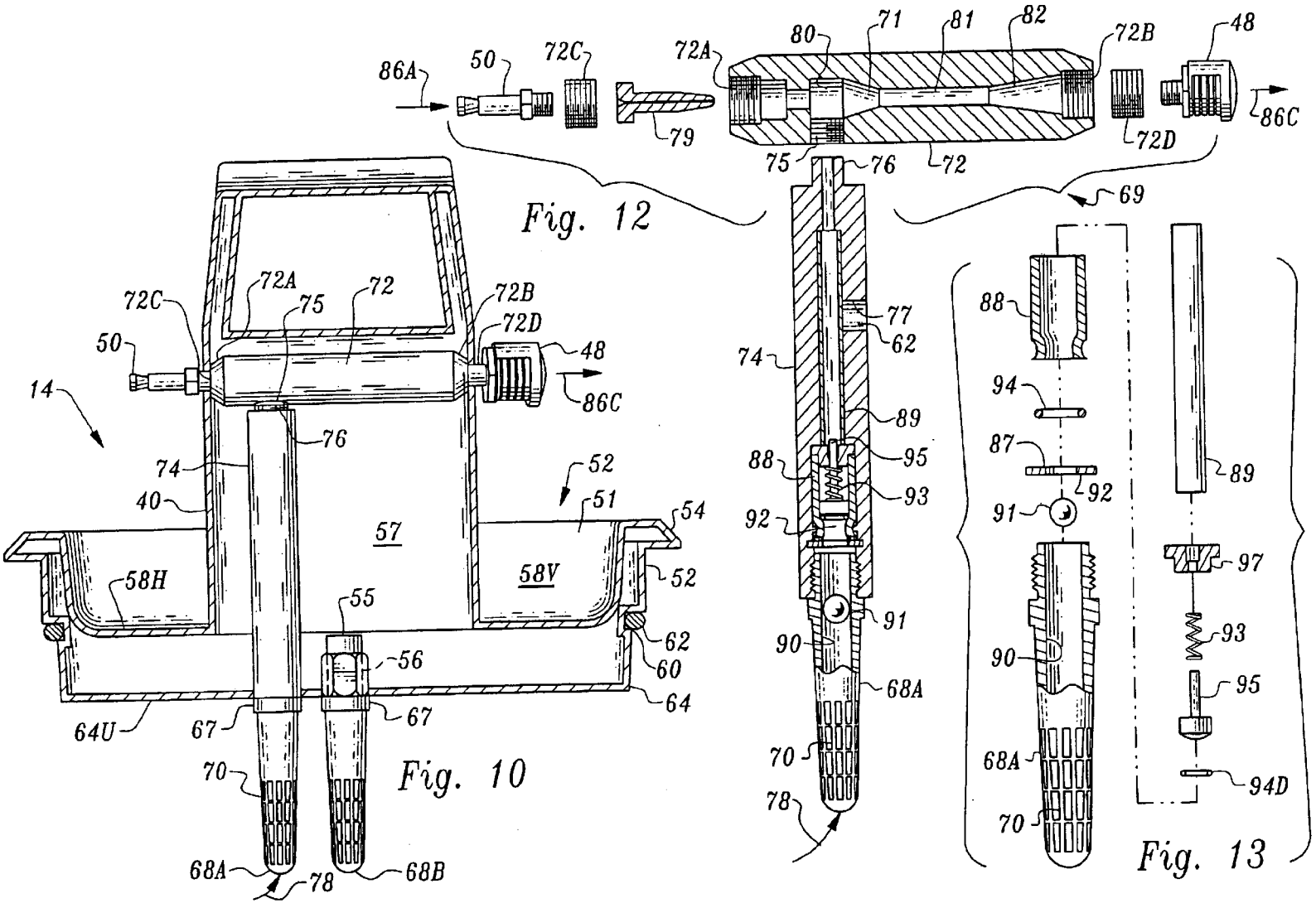
FIG. 10 is an internal sectional view of the lid portion of the invention taken along line 10—10 of FIG. 5.
FIG. 12 is a sectional view of the air evacuation tube shown in FIG. 11.
FIG. 13 is a side elevational view of the venturi and air evacuation tube shown in FIG. 11.
Figure 11:
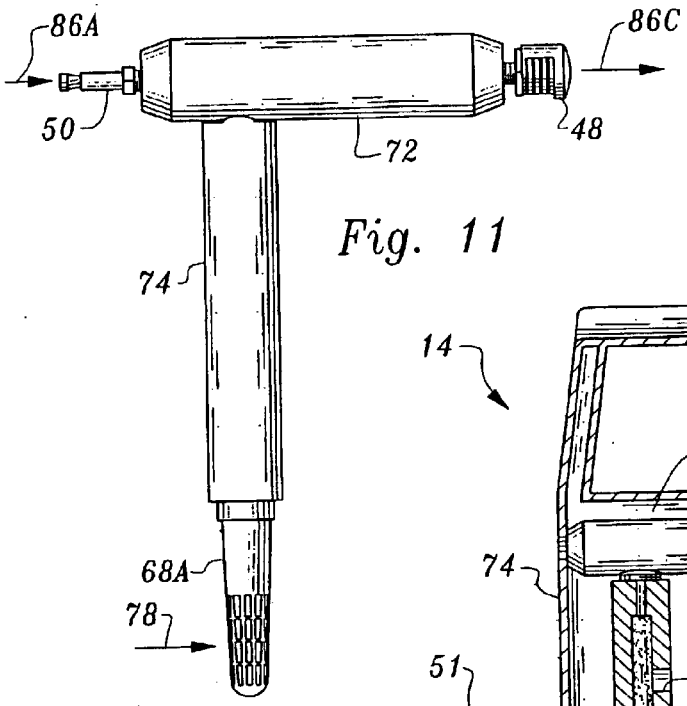
FIG. 11 is a sectional exploded view of the venturi pump and air evacuation tube.
Figure 14:
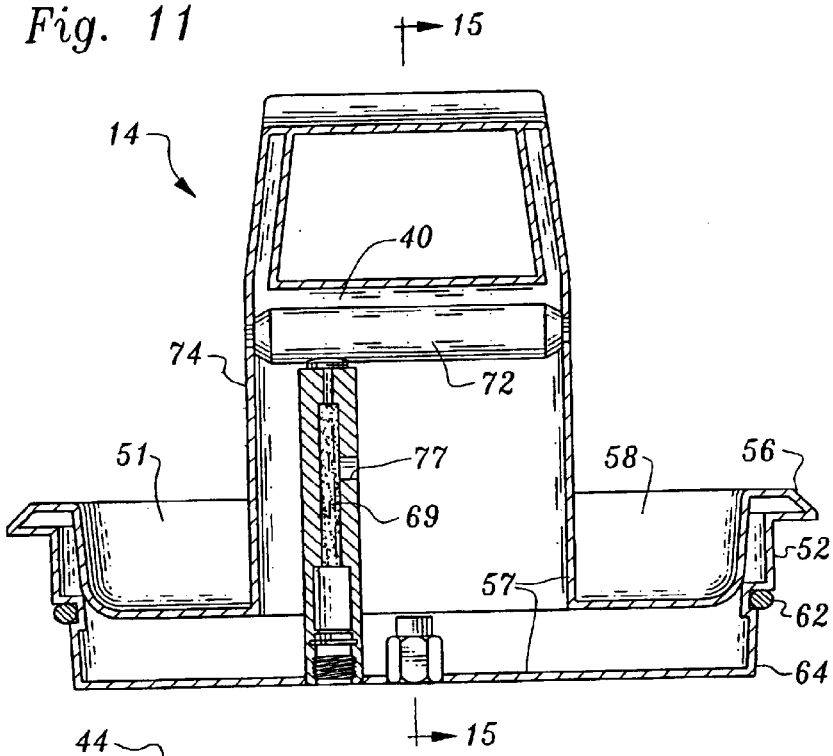
FIG. 14 is a sectional view of the lid portion and the air evacuation tube, with the venturi pump depicted in whole.

Turning to FIGS. 10–12, venturi ejection pump 69 is detailed. Pump 69 includes venturi tube 72 which extends across housing 40. One end of venturi tube 72 includes pneumatic hose quick disconnect plug 50, that threads into reducer bushing 72C, which in turn threads into threaded air inlet aperture 72A. Connector 72C is a conventional reducing bushing, and may take the form of any type of connector that will provide an airtight connection. At the opposite end of venturi tube 72 lies threaded air exhaust aperture 72B that threads into conventional reducer bushing 72D, connected to air exhaust muffler 48.

Venturi tube 72 also includes threaded opening 75, for the receipt of air evacuation tube 74 having threaded interconnection section 76. Such interconnection between air evacuation tube 74, and venturi tube 72 is airtight. The air evacuation tube 74 is seen to pass downward through the hollow interior 57 of the housing 40 and terminate in strainer 68A. Reference character 70 pertains to the slotted section of the tapered suction strainer 68A. It should be apparent that waste fluid nipple 66 is hidden from view due to the orientation of lid portion 14, however FIG. 16 reveals nipple 66.

Figure 15:
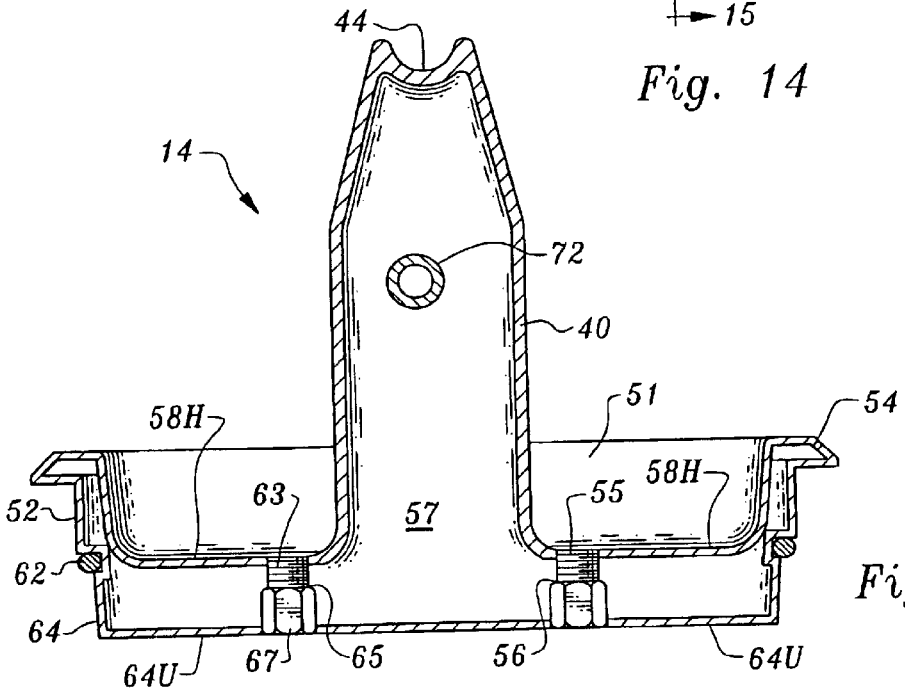
FIG. 15 is another vertical sectional view of the lid portion of this invention taken along line 15—15 of FIG. 14.

With further reference to FIG. 10, strainer 68B connected to alternate port nipple 55, can house a spare ball and check valve (not shown). Cap 43 has been removed from nipple 55. Strainer 68B is threaded into conventional hose connector 67, which forms part of coupling 56. Coupling 56 is recessed in lid 14, discussed hereinafter in the text pertaining to FIG. 15, and is located level with recessed section 64 of lid 14 within chamber 57. Lid cover 52 having vertical wall 58V and horizontal wall 58H, is designed to allow vacuum tubing 15 to be stored in the well 51 so defined, when not in use.

FIGS. 11–15 detail venturi ejector pump 69 and the operative mechanism of the venturi tube 72. Air is introduced, directional arrow 86A, into threaded aperture 72A and then to chamber 80. The air is compressed through nozzle 79 circumvented by bushing 72C, which is also threaded to threaded aperture 72A. As the air exits nozzle 79 at an increased velocity, it passes to converging chamber 71, and flows through the expansion tube 81. The air continues to expand and flow out of diverging chamber 82, while pulling air from evacuation tube 74 and liner insert 13, directional arrow 78. Air from venturi 72 exits aperture 72B and muffler 48, directional arrow 86C. Thus, air entering venturi 72 at aperture 72A and through air evacuation tube 74 eventually passes through muffler 48.

Air evacuation tube 74, FIGS. 11 and 12, possesses vent tube bore 77, used to allow gases to be relieved during the manufacturing process. After the manufacturing process is completed tubular insertion plug 62 covers up the end of vent tube bore 77. Closing off of bore 77 is necessary to prevent contaminants from entering chamber 57, of lid 14. Check valve body 88 also resides in air evacuation tube 74. FIG. 12 shows the relation between the check valve body 88, "o" ring 94, check valve retainer 87, float check ball 91, and the suction strainer 68A. Retainer 87 may be in the form of a rubber washer having seat 92. As air is evacuated through the insertion tube 89, air movement lifts check valve plunger 95, compressing coil spring 93. This allows air to flow from the liner insert 13 through the suction strainer 68A, directional arrow 78, and complete its path to the venturi chamber 80. When the negative pressure is no longer present in venturi tube 72, check valve spring 93 relaxes, and plunger 95 back seats against plunger "o" ring 94D. Plunger retainer 97 guides plunger 95 in its movements.

Referring again to FIGS. 11 and 12, below check valve body 88, and check valve retainer 87 is found a float check ball 91. The float check ball 91 has a specific gravity of less than lightweight hydrocarbon liquids and rests inside of the bottom of inner raceway element 90 of strainer 68A, threaded into the bottom of the air evacuation tube 74. The purpose of float check ball 91 inside of suction strainer raceway 90 is to provide liquid level control to chamber 18 of inner liner insert 13. As the liquid level rises above bottom portion of suction strainer 68A, fluid check ball 91 rises to finally seat against float ball seat 92 of retainer 87. Flow check ball 91, held against seat 92, will prevent liquid flow through air evacuation tube 74 from inner liner chamber 18.

Figure 17:
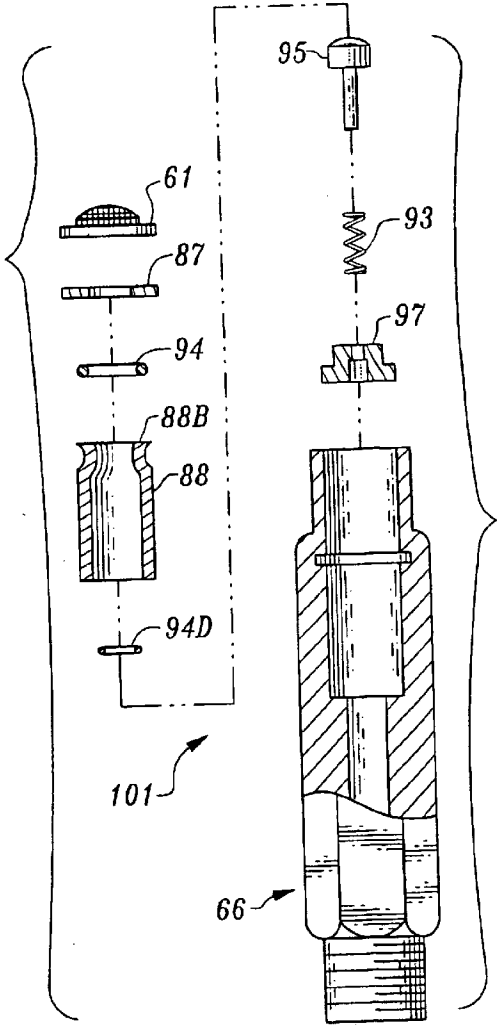
FIG. 17 is an exploded view showing the check valve assembly contained in the waste fluid entrance of FIG. 16.

It should be noted that if device 10 is inadvertently tipped over, plunger 95 will prevent liquid from escaping through air evacuation tube 74. A similar check valve 101 prevents fluid from escaping through waste fluid inlet 63, shown on FIG. 17 hereinafter described. "o" ring 62 also seals apparatus 10 to prevent spillage between inner liner 13, container 12, and lid 14, as a further liquid control measure.

FIG. 16 illustrates the nesting of outer bucket 12 with liner insert 13, and the positioning of lid section 14 thereover. "o" ring seal 62 can clearly be viewed in relation to recessed section 64, thereof, which will be further described hereinafter. The cutaway section of FIG. 16 reveals the presence of hose connector quick disconnect 53 in liquid communication with threaded nipple 63, which engages coupling 65. FIG. 16 also illustrates waste liquid entering liner insert 13. The waste liquid flows through flexible hose 15L, directional arrow 98, passes through quick connector 15Q to connector 53 which is attached to nipple 63 engaging embedded coupler 65. Fluid then enters inner liner 13 through nipple 66 attached to coupler 65 via coupler 84 directional arrow 100. Disposed within coupler 84 in coupling 65 lies coarse wire filter 61, FIG. 17. Wire filter 61 prevents particulate matter from entering check valve 101, causing check valve 101 to fail. Focusing on FIG. 17, the internal operation of check valve 101, residing within end coupler 84 is discussed. The purpose of check valve 101 is to provide an additional check seal if unit 10 is inadvertently tipped over while in the inoperative mode. That is to say, should venturi 72 be turned off, fluid would not spill from apparatus 10. The components of check valve 101 are similarly numbered with respect to identical check valve components shown in FIG. 12 with respect to air evacuation tube 74.

Figure 18:
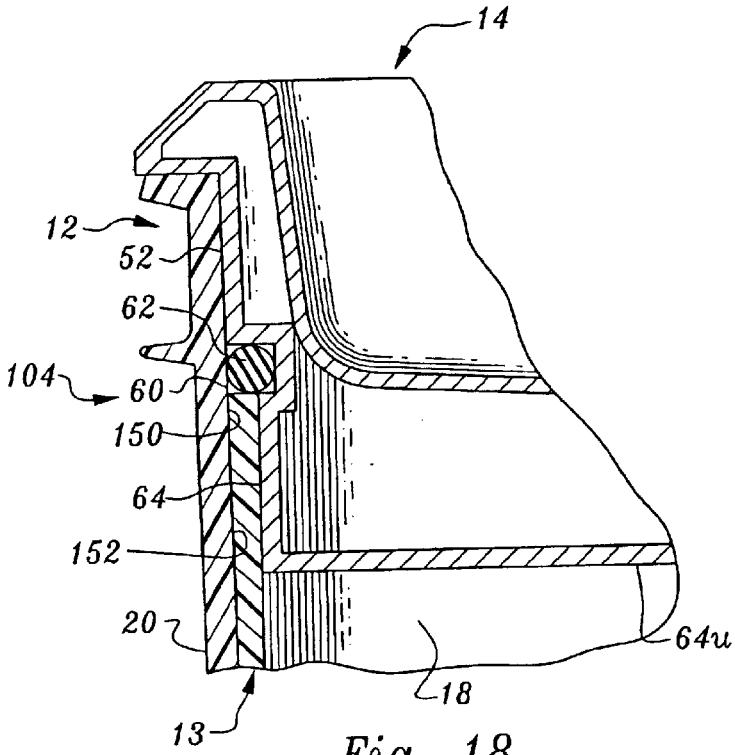
FIG. 18 is a sectional view showing the positioning of the bucket, lid portion, and liner insert prior to sealing.
Figure 19:
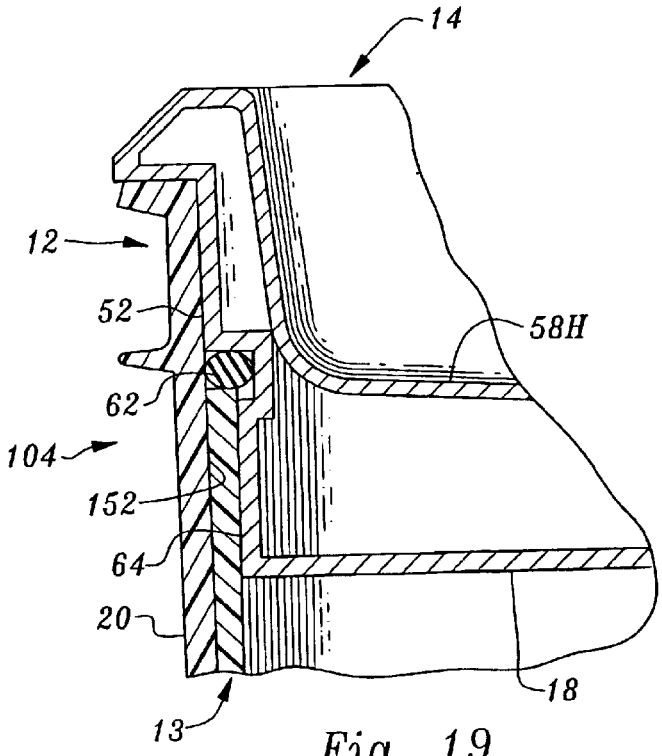
FIG. 19 is a sectional view showing the sealing of the bucket, lid portion and liner of FIG. 18 after activation of the venturi pump.

FIG. 18 depicts the positioning of bucket 12 relative to lid 14 and liner insert 13, as well as the operation of sealing means 104. "o" ring 62 contacts edge 150 of liner 13 and lies adjacent inner wall 152 of bucket 12 when recessed section 64 of lid 14, "o" ring lies within recess 60. Upon the application of a vacuum within liner insert 13 by the activation of venturi pump 72, "o" ring 62 seals bucket 12, liner 13, and lid 14 at inner wall 152, edge 150 and recess section 64 respectively, FIG. 19.

In operation, it should be appreciated that waste liquid can be fed into chamber 18 of liner insert 13 through one of two vacuum port openings, nipples 55 or 63. Moreover, the internal threads of couplers 56 and 65 are preferably standard garden hose threads, although other threads may be employed. This combination allows nipple 66 to be transferred from the inside of liner insert 13 to other portions of unit 10 as desired by the user. Waste fluid travels to liner insert 13, the primary holding vessel, when venturi 72 is activated by forcing compressed air through hose 11 to inlet aperture 72 of venturi pump 69. Liner insert 13, placed within bucket 12, provides extra strength to unit 10 and guards against inadvertent spillage of waste liquid during the transfer of the same to inner liner 13. During such transfer, handle of outer bucket 26 is rotated to the top portion of lid 14 such that handle grabber 28 clamps into trough 44. Concurrently, handle 39 of inner liner 13 is rotated into the position shown in FIG. 4. In this manner, sealing means 104 is not interfered with by any of the handle portions of apparatus 10. When liner 13 is filled to capacity, ball 91 and raceway 90 of tube 74, FIG. 11 will seal against check valve seat 92. This causes liquid flow into inner liner 13 to cease. When the flow check ball 91 seats against ball check valve 88 and seals on seat 92, the flow rate of air emanating from muffler 48 of unit 10 will change, providing an audio signal to the user that full level has been reached. If venturi pump 72 is deactivated vacuum will be maintained in system 10 due to check valve 88 within air evacuation tube 74, and check valve 101 associated with nipple 66, and "o" ring 62 sealing containers 12 and 13. This aspect of the present invention permits system 10 to be carried via handle section 42 and without component separation should system 10 be dropped.

While in the foregoing embodiments of the invention have been set forth in considerable detail for the purposes of making a complete disclosure of the invention, it may be apparent of those of skill in the art that numerous changes may be made in such details without departing from the spirit and principles of the invention.

What is claimed is:

1. An apparatus for the removal of liquid from a source employing compressed air, comprising:

a. a first container having a wall portion forming an open chamber;

b. a second container having a wall portion forming an open chamber;

c. a lid having at least one liquid inlet therethrough to said chamber of said second container, and at least one air outlet from said chamber of said second container;

d. a compressed air operated venture pump located at said lid, said venture pump communicating with said air outlet of said lid;

e. sealing means for sealing said lid, first container and second container upon the application of compressed air to said venture pump; and f. a hose connected to the source of liquid and said liquid inlet at said lid.

2. The apparatus of claim 1 in which said venture pump possesses an air outlet and an air inlet and further comprises an air evacuation tube communicating with said venture pump and the chamber of said second container.

3. The apparatus of claim 2 which further comprises a muffler connected to said air outlet of said venture pump.

4. The apparatus of claim 1 in which said first container includes a handle and said lid includes a recess for accommodating at least a portion of said first container handle.

5. The apparatus of claim 4 in which said second container includes a handle which lies within said second container upon activation of said sealing means.

6. The apparatus of claim 1 which further comprises a valve to prevent overfilling of liquid from the source, in said second container chamber during operation of said venture pump.

7. The apparatus of claim 1 which further comprises check valve means in said air outlet to prevent passage of liquid therethrough from said second container.

8. The apparatus of claim 1 which further comprises a second liquid inlet to said second container said lid.

9. The apparatus of claim 1 which further comprises a well to hold said hose.

10. The apparatus of claim 1 in which said sealing means comprises a sealing ring and a recess in said lid to hold said sealing ring, said sealing ring sealingly contacting said first and second container upon the activation of said venture pump.

11. The apparatus of claim 10 in which said venture pump possesses an air outlet and an air inlet and further comprises an air evacuation tube communicating with said venture pump and the chamber of said second container.

12. The apparatus of claim 11 which further comprises a muffler connected to said air outlet of said venture pump.

13. The apparatus of claim 10 in which said first container includes a handle and said lid includes a recess for accommodating at least a portion of said first container handle.

14. The apparatus of claim 13 in which said second container includes a handle which lies within said second container upon activation of said sealing means.

15. The apparatus of claim 10 which further comprises a valve to prevent overfilling of liquid from the source, in said second container chamber during operation of said venture pump.

16. The apparatus of claim 10 which further comprises check valve means in said air outlet to prevent passage of liquid therethrough from said second container.

17. The apparatus of claim 10 which further comprises a second liquid inlet to said second container at said lid.

18. The apparatus of claim 10 in which said lid further comprises a well to hold said hose.

* * * * *